US009815073B2

(12) United States Patent
Huffman et al.

(10) Patent No.: US 9,815,073 B2
(45) Date of Patent: Nov. 14, 2017

(54) SPRAY MANIFOLD WITH INDIVIDUAL LIQUID FEED SPRAY GUNS

(71) Applicant: Spraying Systems Co., Wheaton, IL (US)

(72) Inventors: David C. Huffman, Merrimack, NH (US); Russell R. Frechette, Pelham, NH (US); Joseph P. Szczap, Naperville, IL (US); Bo R. Buhl, Walnut Creek, CA (US)

(73) Assignee: Spraying Systems Co., Wheaton, IL (US)

( * ) Notice: Subject to any disclaimer, the term of this patent is extended or adjusted under 35 U.S.C. 154(b) by 23 days.

(21) Appl. No.: 14/786,195

(22) PCT Filed: Apr. 23, 2014

(86) PCT No.: PCT/US2014/035081

§ 371 (c)(1),
(2) Date: Oct. 22, 2015

(87) PCT Pub. No.: WO2014/176308

PCT Pub. Date: Oct. 30, 2014

(65) Prior Publication Data

US 2016/0089682 A1 Mar. 31, 2016

Related U.S. Application Data

(60) Provisional application No. 61/815,125, filed on Apr. 23, 2013.

(51) Int. Cl.
*B05B 7/08* (2006.01)
*B05B 7/00* (2006.01)
(Continued)

(52) U.S. Cl.
CPC ..... *B05B 7/0815* (2013.01); *B05B 1/3013* (2013.01); *B05B 1/3093* (2013.01);
(Continued)

(58) Field of Classification Search
CPC ... B05B 7/0884; B05B 7/0815; B05B 15/069; B05B 7/0081; B05B 7/1254; B05B 7/2489
(Continued)

(56) References Cited

U.S. PATENT DOCUMENTS 3,589,610 A * 6/1971 Wahlin ..... B05B 9/01 239/125
5,571,562 A * 11/1996 Wakat ..... B05B 7/066 118/315
(Continued)

*Primary Examiner* — Alexander Valvis
(74) *Attorney, Agent, or Firm* — Leydig, Voit & Mayer, Ltd.

(57) ABSTRACT

A modular spray gun manifold having a plurality of spray gun modules arranged in a lateral array each separated by an adjacent support assembly. Each spray gun module has a central liquid passage communicating with a spray nozzle and a transversely oriented liquid inlet port communicating through an outer side of the spray gun module for connection with an independently controllable liquid supply. The spray gun modules further include a recirculation port communicating between the central passageway and a recirculation conduit in an adjacent support assembly. A control valve of each module is operable when in open spraying position for blocking communication of liquid from the central passageway to the circulation port and when in a valve closing position blocking the liquid flow to the spray nozzle while redirecting liquid from the liquid inlet to the recirculation port for recirculation through the manifold array.

18 Claims, 8 Drawing Sheets

(51) Int. Cl.

| | |
|---|---|
| ***B05B 13/02*** | (2006.01) |
| ***B05B 15/04*** | (2006.01) |
| ***B05B 1/30*** | (2006.01) |
| ***B05B 15/06*** | (2006.01) |

(52) U.S. Cl.
CPC ..... *B05B 7/0081* (2013.01); *B05B 7/0884* (2013.01); *B05B 13/0278* (2013.01); *B05B 15/0406* (2013.01); *B05B 15/069* (2013.01)

(58) Field of Classification Search
USPC ..... 239/548, 550, 551
See application file for complete search history.

(56) References Cited

U.S. PATENT DOCUMENTS 5,707,010 A * 1/1998 Manfre ..... B05B 7/066 239/296
2005/0035225 A1 * 2/2005 Huffman ..... B05B 15/069 239/548

* cited by examiner

VALVE NEEDLE IN OPEN POSITION

VALVE NEEDLE IN CLOSED POSITION

SPRAY MANIFOLD WITH INDIVIDUAL LIQUID FEED SPRAY GUNS

CROSS-REFERENCE TO RELATED APPLICATION

This patent application claims the benefit of U.S. Patent Application No. 61/815,125, filed Apr. 23, 2013, which is incorporated by reference.

FIELD OF THE INVENTION

The present invention relates generally to spray gun type liquid spray devices, and more particularly, to a spray gun manifold having a modular construction.

BACKGROUND OF THE INVENTION

Modular spray gun manifold assemblies that include a plurality of laterally spaced spray guns supported in a row for discharging an elongated spray pattern are known. Such manifolds are used, for example, in pill coating machines in the pharmaceutical industry. Spray gun manifolds, such as shown in U.S. Pat. No. 7,083,121 B2 assigned to the same assignee as the present application, the disclosure of which is incorporated herein by reference, comprise spray gun modules disposed between respective support assemblies through which pressurized air and liquid are directed for supplying the plurality of spray gun modules. Liquid directed through the manifold also is recirculated back to the liquid supply.

In some spray applications, it is desirable to monitor the liquid supply to each individual spray gun module in order to detect possible blockage in the spray discharge. For this purpose, it has been necessary to individually supply pressurized liquid to the spray gun modules, rather than through the manifold system, in order to more reliably detect the interruption of discharge of the individual spray gun. While it is also desirable that the liquid be continuously recirculated through the system, when pressurized liquid is individually supplied to the spray gun modules, rather than through the manifold system, this has presented problems.

OBJECTS AND SUMMARY OF THE INVENTION

It is an object of the present invention to provide a modular spray gun manifold in which the plurality of spray gun modules have individual pressurized liquid feeds and which facilitates efficient recirculation of the liquid.

Another object is to provide a novel spray gun module for use in such a manifold system.

A further object is to provide a spray gun module of the foregoing type which is relatively simple in construction and lends itself to economical manufacture and reliable usage.

Other objects and advantages of the invention will become apparent upon reading the following detailed description and upon reference to the drawings, in which:

Figure 1:
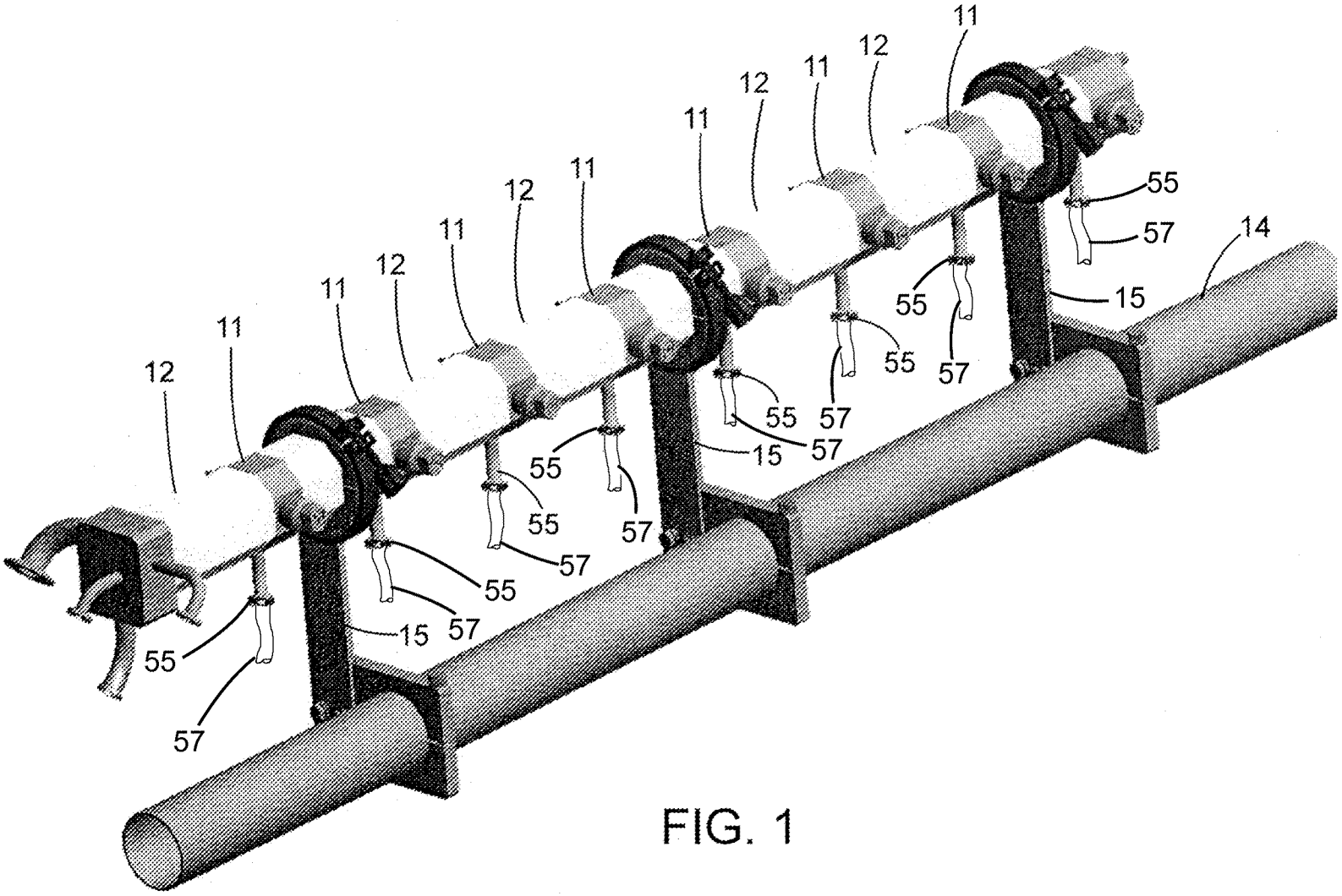
FIG. 1 is a perspective of an illustrative modular spray gun manifold in accordance with the invention mounted on a support structure.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the invention is to cover all modifications, alternative constructions, and equivalents falling within the spirit and scope of the invention.

DESCRIPTION OF THE PREFERRED EMBODIMENT

Referring now more particularly to the drawings, there is shown an illustrative modular spray gun manifold 10 which includes a plurality of spray gun modules 11 in accordance with the invention. The spray gun modules 11 each are interposed between support assemblies 12, and the manifold 10 in this case is mounted on a support pipe 14 by laterally spaced brackets 15. The spray gun modules 11 have lateral sides 23 disposed in abutting relation to lateral sides 27 of adjacent support assemblies 12 and outer exposed forward, rear, upper and bottom sides 24.

Figure 2:
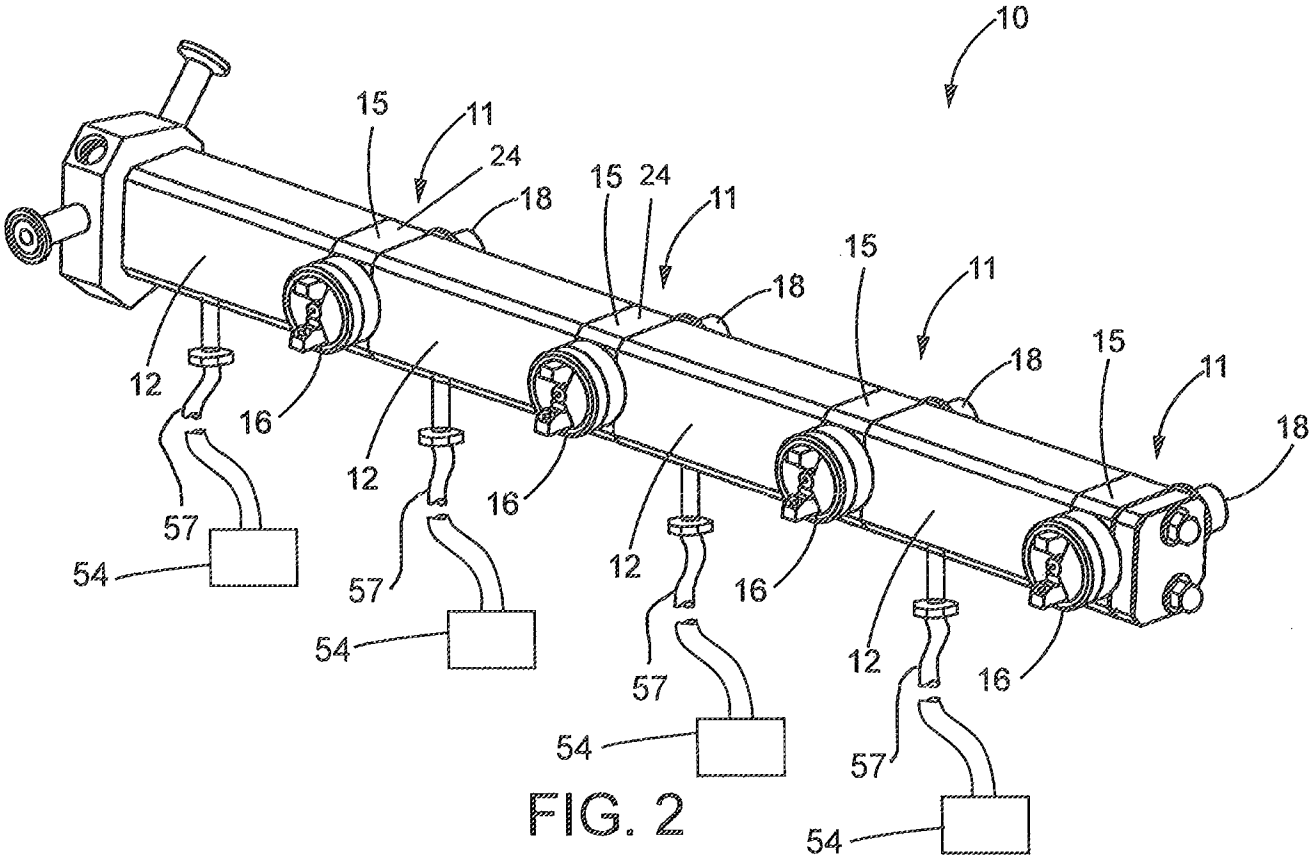
FIG. 2 is a partially diagrammatic depiction of the spray gun manifold shown in FIG. 1.
Figure 4:
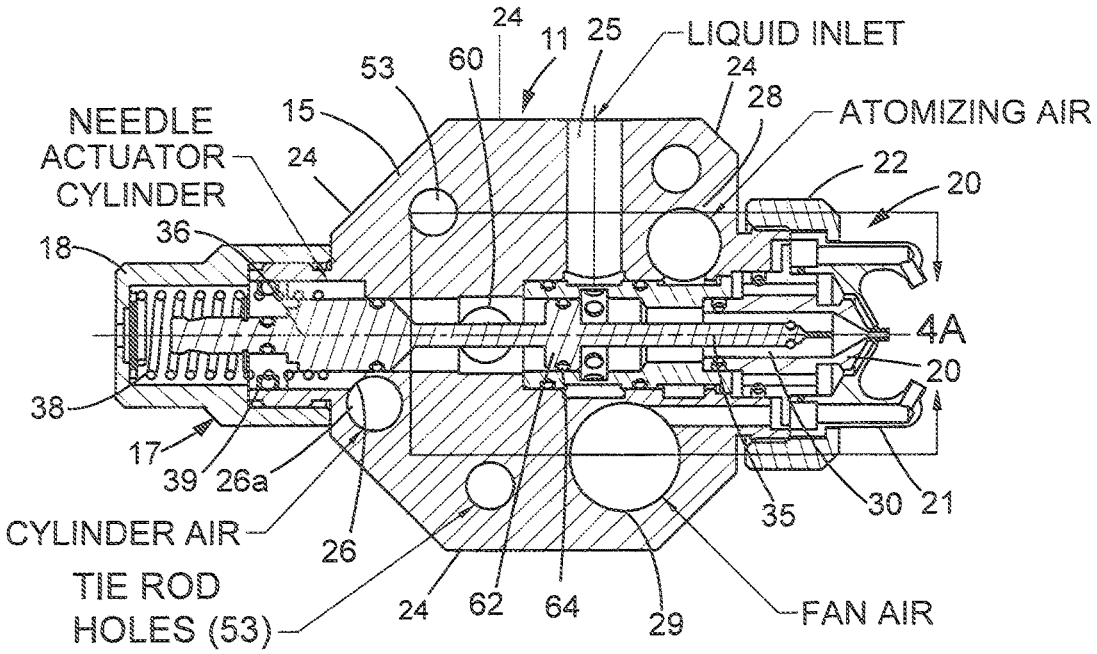
FIG. 4 is a vertical section of one of the spray gun modules of the illustrated manifold showing a flow control valve thereof in an open position and in this case depicting a liquid inlet in an upper exposed side.
Figure 4A:
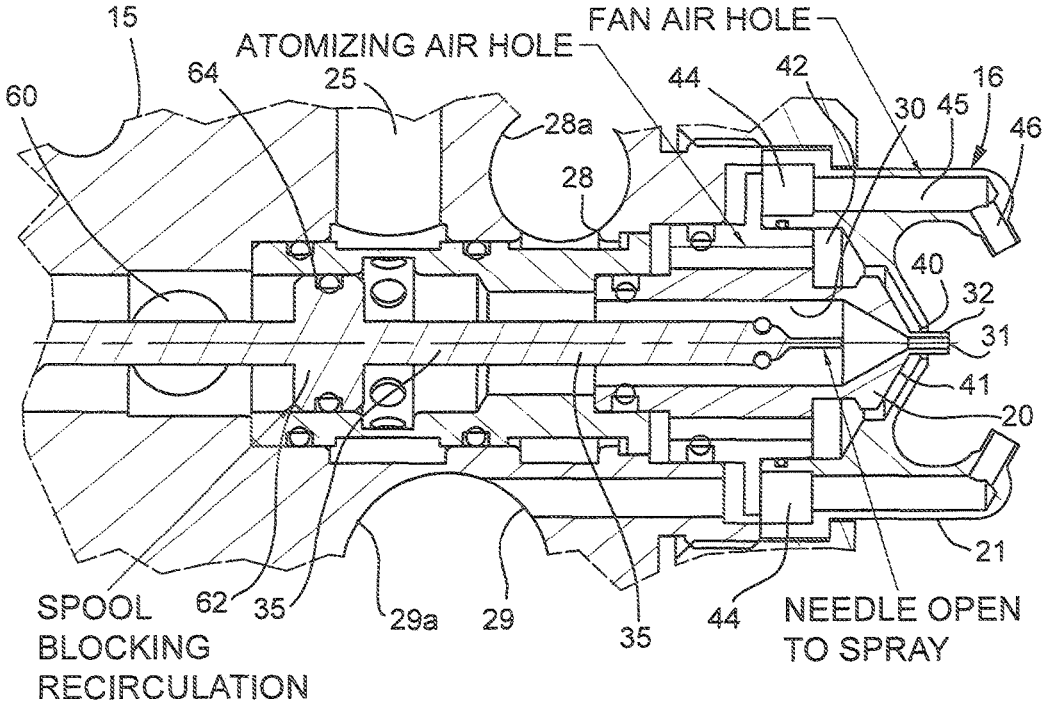
FIG. 4A is an enlarged fragmentary section of the discharge end of the spray gun module shown in FIG. 4.
Figure 5:
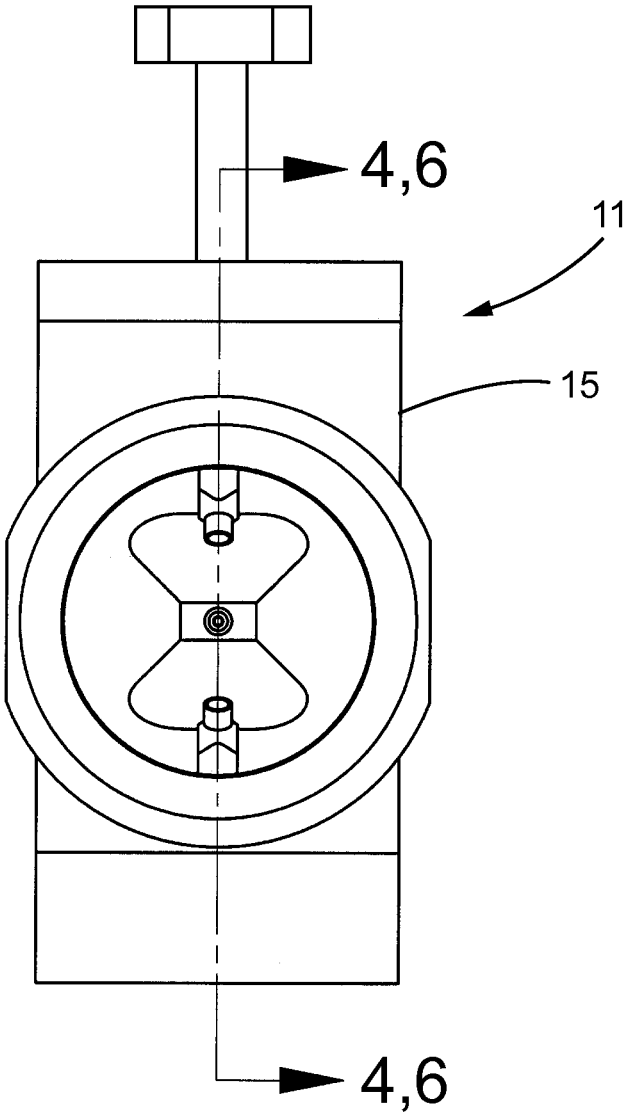
FIG. 5 is an end view of the discharge end of the spray gun module shown in FIG. 4.
Figure 6:
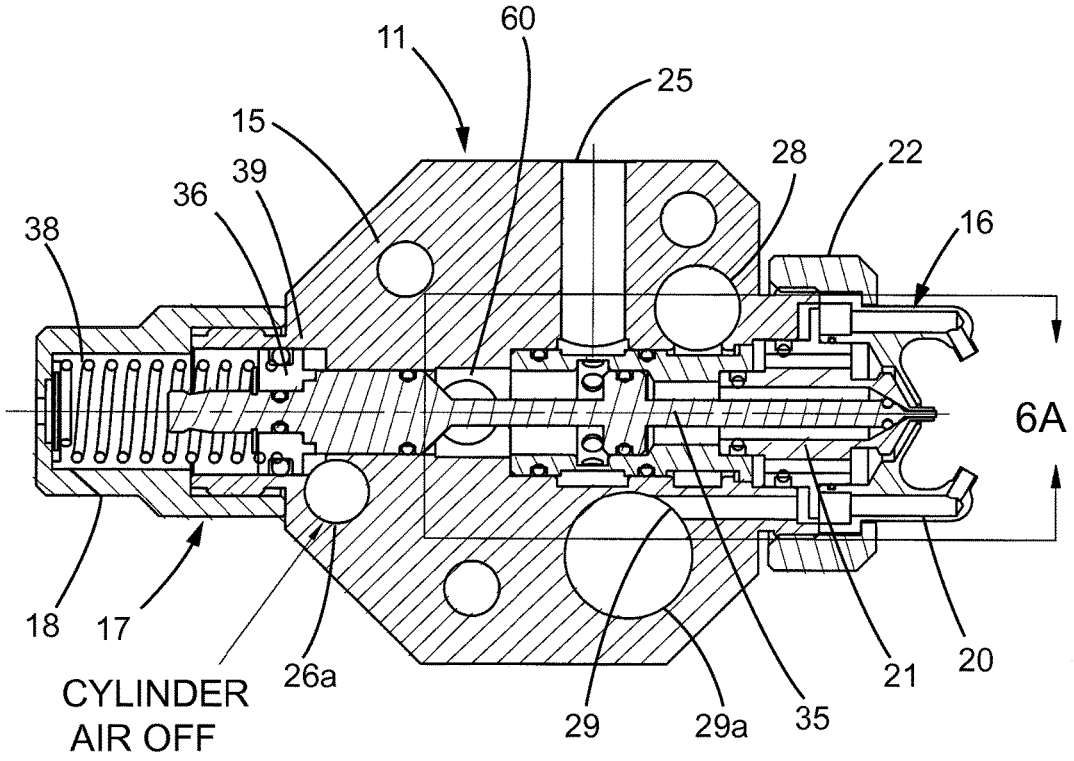
FIG. 6 is a vertical section of the spray gun module, similar to FIG. 4, showing the flow control valve end of the module in an closed position.

Each illustrated spray gun module 11 includes a generally blocked shaped body 15, a spray nozzle assembly 16 supported on a front exposed side 24 of the module body 15, and a valve actuator 17, and end cap 18 supported at the opposite rear exposed side 24 of the modular body 15, as depicted in FIG. 2. The illustrated spray nozzle assembly 16 includes a spray tip or nozzle insert 20 and an air cap 21 mounted in overlying surrounding relation to the spray tip 20 (FIG. 4A) and retained on the nozzle body 15 by a retaining nut 22. The nozzle body 15 has a liquid inlet 25, a cylinder air inlet 26, an atomizing air inlet 28, and a fan air inlet 29 (FIG. 4). Liquid is supplied to the inlet 25 communicates with a central longitudinal passageway 30 in the nozzle body 15 and spray tip 20 and through a liquid discharge orifice 31 defined by a forwardly extending nose portion 32 of the spray tip 20 (FIG. 4A). In the illustrated embodiments, it will be understood that the liquid inlet 25 may communicate through the bottom expose side 24 (FIGS. 1-3) or the upper exposed (FIGS. 4-6).

For controlling the discharge of liquid from the spray gun module 11, a valve needle 35 coaxially extends through the housing body 15 for reciprocating movement between a valve closing position in seated engagement with a downstream tapered entry section of the spray tip passageway 30 and an unseated valve open position. The valve needle 35 in this case has a tapered seating section and an axially extending clean out nose portion that is positionable into and through the discharge orifice 31 when in a closed position (FIG. 6A) for maintaining the passage free of buildup during usage.

For operating the valve needle 35, a piston 36 is mounted at an upstream end of the needle 35 which is biased in a valve closing direction by a compression spring 38 interposed between the piston 36 and the upstream actuator cap 18 (FIG. 4). The piston 36 carries an annular sealing ring 39 in sealing engagement with a cylindrical bore in the housing body 15. The compression spring 38 biases the piston 36, and hence the valve needle 35, forwardly to a fully seated, i.e., valve closed position, depicted in FIG. 6. The valve needle 35 is moveable axially in the opposite direction (to the left in FIG. 6) against the force of the spring 38 by pressurized air (i.e. "cylinder air") selectively directed into the cylinder air inlet 26, which communicates through the housing body 15 with an air chamber on the downstream side of the piston 36 in a known manner.

For atomizing the liquid discharging from the spray tip 20, the spray tip nose portion 32 and a central orifice of the air cap 21 define an annular atomizing air discharge orifice 40 which communicates with angled atomizing air passages 41 and an annular air passage 42 defined between the spray tip 20 and air cap 21, which in turn communicates through nozzle body 15 with the atomizing air inlet 28. Pressurized air directed through the annular discharge orifice 40 communicates outwardly in surrounding relation to the liquid discharge orifice 31 for interaction with the discharging liquid flow stream.

For forming and directing the discharging liquid spray into a flat fan spray pattern for wider lateral application, each spray gun module 11 is operable for impinging pressurized air (i.e., "fan air") on opposite sides of the liquid spray. Pressurized air from the fan air inlet 29 of the spray gun module 11 communicates through the nozzle body 15 with an annular chamber 44 adjacent an upstream end of the air cap 21. The annular chamber 44 communicates pressurized air to a pair of longitudinal passages 45, which terminate in opposed angled discharge passages 46 that direct pressurized air streams at an acute angle on opposite sides of the discharging liquid spray for spreading the liquid spray into a relatively flat narrow spray pattern.

Figure 3:
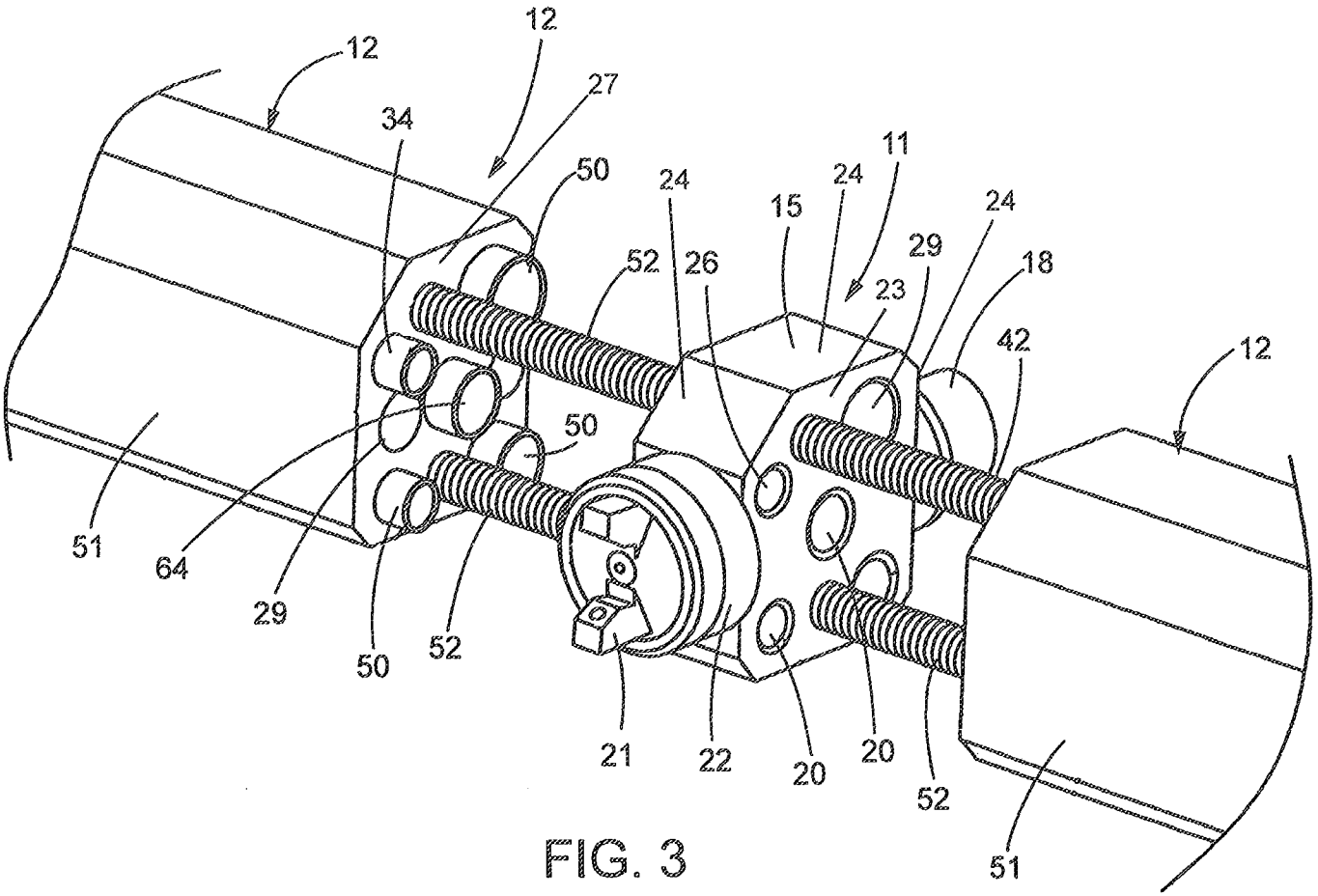
FIG. 3 is an enlarged, partially exploded, perspective of the modular spray gun manifold shown in FIG. 2, showing one of the spray gun modules and the adjacent support assemblies in separated relation to each other.

For communicating atomizing air, fan air, and control air to the spray gun modules 11, the cylinder air inlet 26, atomizing air inlet 28, and fan air inlet 29 each is defined by a respective fluid passage 26*a*, 28*a* and 29*a* that extend transversely through opposite sides of the module body and which communicate with fluid conduits 50 in the adjacent support assemblies 12 which supply atomizing air, cylinder and control air though the manifold 10, as best shown in FIG. 3. The support assemblies 12 in this case are blocks 51 within which the fluid conduits 50 are supported. The fluid conduits 50 each preferably extend outwardly a small distance beyond the respective ends of the blocks 51 for insertion into the passages of the spray gun manifold, with a threadless union therebetween (see. e.g., FIG. 3). Threaded retaining rods 52 in this instance extend through aligned holes 53 in the spray gun modules 11 and support assemblies 12 for retaining the modules and support assemblies in assembled relation to each other.

In accordance with one aspect of the invention, each spray gun module has a respective individual pressurized liquid feed or supply, which lends itself to reliable monitoring of the spray discharge while permitting circulation of the supply liquid through the manifold for return to the liquid supply. To this end, the liquid inlet 25 of each spray gun module body 15 is connected to a respective liquid supply 54. In the illustrated embodiment, each module body 15 has a liquid inlet fitting 55 protruding outwardly of an outer exposed side 24 of the spray gun module for easy connection to a supply line 57 coupled to the liquid supply. In the illustrated embodiments, the liquid inlet fitting 55 is disposed in a bottom exposed side of the spray gun module (FIGS. 1-3) or in an upper exposed side 24 (FIGS. 4-6). It will be understood by a person skilled in the art that the inlet fittings 55 and respective supply lines may be coupled to individual liquid supply pumps, or alternatively to a multiple feed pump operable for selectively directing pressurized liquid individually to the inlet fittings 55 and the respective spray gun modules 11.

In keeping with the illustrated embodiment, when the valve needle 35 is moved to the off or closed position, as depicted in FIG. 6, the liquid inlet 25 is enabled to communicate with a recirculation port 60 extending transversely to the block housing 15 of the spray gun module 11 for permitting continued recirculation of the liquid through the manifold 10 via passages in the spray gun modules 11 and support assemblies 15. To this end, the valve needle 35 carries a plunger 62 intermediate its end which is movable within an enlarged passage section 6 upstream of the central fluid passageway 30 (FIG. 4A). The plunger 62 includes an outer annular seal 64 for sealing slide-able contact with the enlarged passageway section 6.

Figure 6A:
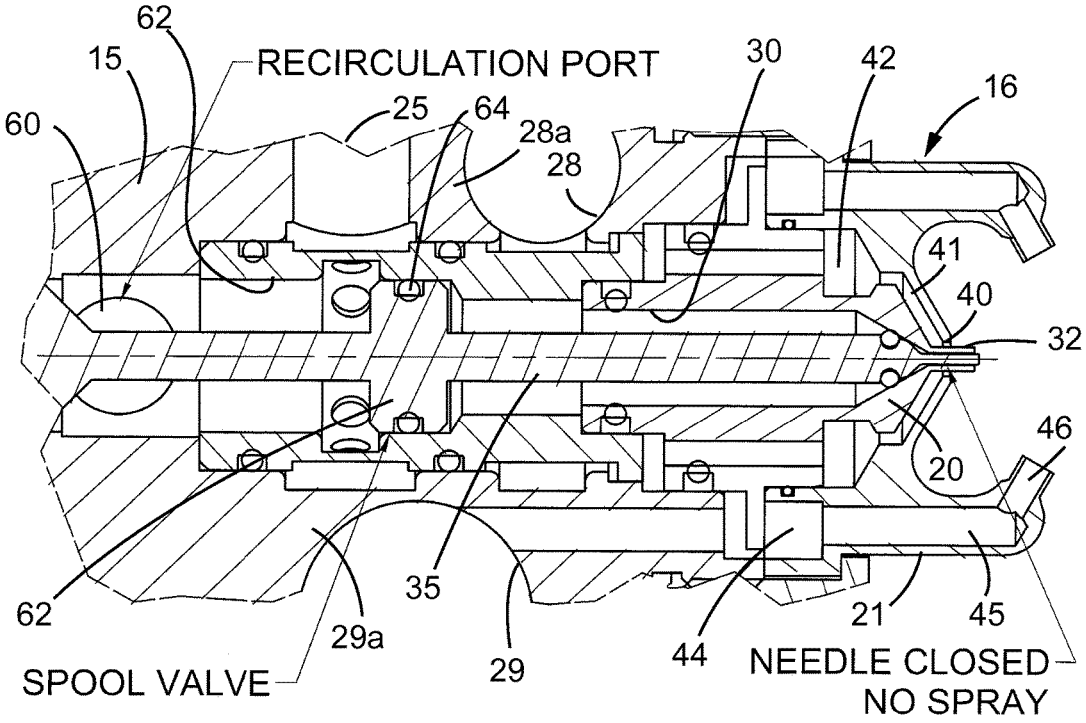
FIG. 6A is an enlarged fragmentary section of the discharge end of the spray gun module shown in FIG. 6

When the valve needle 35 is in the open position during spraying (FIG. 4A), the plunger 62 is disposed at a location between the liquid inlet 25 and the recirculation port 60 preventing the communication of liquid from the liquid inlet 25 to the recirculation port 60. As an incident to movement of the valve needle 35 to the shutoff position, as shown in FIG. 6A under the force of the spring 38 upon discontinuation of the actuating air, the plunger 62 is moved with the valve needle 35 to a position downstream of the liquid inlet 25 for permitting the continuous communication of liquid from the liquid inlet 25 to the recirculation port 60 for recirculation through the manifold 10. For this purpose, the recirculation port 60 extends transversely through the block housing 15 for communicating with recirculation tubes 64 in the adjacent support assemblies 12, which thereby enable the liquid to be recirculated through the manifold and return to the liquid supply regardless of whether the valve needles in the other spray gun modules 11 are in open or closed positions.

Hence, it can be seen that a spray gun manifold is provided in which the spray guns modules have individual liquid feeds or supplies that enables more reliable monitoring of interruptions or changes in liquid pressure and spray discharge. Yet, the spray gun modules enable automatic recirculation of the supply liquid through the manifold system when any of the valve needles of any of the spray gun modules are in their shutoff positions.

The invention claimed is:

1. A modular spray gun manifold comprising:

a plurality of spray gun modules arranged in a lateral array, a plurality of support assemblies, said each spray gun module being arranged between pairs of individual support assemblies of said plurality of support assemblies for supporting the plurality of spray gun modules in laterally spaced relation to each other;

said plurality of spray gun modules each including a nozzle body and a spray nozzle having a liquid discharge orifice;

said plurality of spray gun modules each defining a central liquid passageway communicating with the discharge orifice of the respective spray nozzle;

said nozzle body having lateral sides disposed in abutting side by side relation to lateral sides of the adjacent pairs of the individual support assemblies;

said nozzle body each having outer exposed sides between the lateral sides;

a valve needle disposed within said central liquid passageway of the nozzle body for reciprocating movement between a valve closing position for preventing discharge of liquid from said spray nozzle discharge orifice and a valve open position for enabling liquid passage through said central liquid passageway and liquid discharge orifice;

said plurality of support assemblies each having a respective fluid conduit for communicating pressurized air from a pressurized air source successively through said plurality of support assemblies and plurality of spray gun modules for atomizing, shaping, or controlling liquid discharge from the plurality of spray gun modules;

said plurality of spray gun modules each having a respective liquid inlet in one of the outer exposed sides of the nozzle body of the respective spray gun module communicating with the central liquid passageway of the spray gun module for directing liquid from a liquid supply remote from the spray gun module to the central liquid passageway thereof;

said plurality of support assemblies each having a liquid recirculation conduit for communicating liquid successively through said plurality of support assemblies and plurality of spray gun modules for return to a liquid supply, said plurality of spray gun modules each having a liquid recirculation port communicating between the central liquid passageway of the spray gun module and the recirculation conduit of an adjacent support assembly; and said valve needle being operable when in the open position for enabling communication of liquid from the respective liquid inlet through the central liquid passageway for discharge from the spray nozzle discharge orifice while blocking the communication of liquid from the central liquid passage to the recirculation port, and said valve needle being operable when in the valve closing position for blocking the flow of liquid from the central liquid passage to the spray nozzle discharge orifice and redirecting liquid from the liquid inlet to the recirculation port for communication to the recirculation conduit of the adjacent support assembly for recirculation to the liquid supply.

2. The spray gun manifold of claim 1, in which the plurality of spray gun module each have an independently controllable liquid supply to the liquid inlet.

3. The spray gun manifold of claim 1, in which the liquid inlet communicates with said central liquid passageway at a first location, said liquid recirculation port communicates with said central liquid passage at a second location spaced from the first location, said valve needle having a spool disposed at a location intermediate said liquid inlet port and said liquid recirculation port when said valve needle is in said valve open position for enabling the flow of liquid through said central liquid passage and liquid discharge orifice while blocking the flow of liquid from said liquid inlet to said recirculation port.

4. The spray gun manifold of claim 3, in which each of the valve needle are independently controllable so that when the valve needle is in said valve closing position liquid communicates from the liquid inlet to the recirculation port and the recirculation conduit of said adjacent support assembly.

5. The spray gun manifold of claim 3, in which said spool of the valve needle when the valve needle is in said valve closing position being disposed at a location for permitting communication of liquid from said liquid inlet port to said central liquid passage and said recirculation port to the recirculation conduit of the adjacent support assembly.

6. The spray gun manifold of claim 3, in which the liquid inlet communicates with the central liquid passageway at a location along the central liquid passageway intermediate the spray nozzle discharge orifice and the recirculation port.

7. The spray gun manifold of claim 1, in which said each spray gun module of said plurality of spray gun modules has a respective liquid supply line externally of said spray gun module coupled to the liquid inlet of the spray gun module.

8. The spray gun manifold of claim 1, including an actuator for selectively moving the valve needle of said each spray gun module of said plurality of spray gun modules between said open and closing positions.

9. The spray gun manifold of claim 1, in which the spray nozzle of said each spray gun module of said plurality of spray gun modules includes an air cap and one of the fluid conduits in each of the plurality of support assemblies communicates pressurized air to the respective air caps of the plurality of spray gun modules.

10. The spray gun manifold of claim 1 in which said spray nozzle is disposed in a forward exposed side of the nozzle body thereof, and said liquid inlet is in an upper exposed side of the nozzle body.

11. The spray gun manifold of claim 1 in which said spray nozzle is disposed in a forward exposed side of the nozzle body thereof, and said liquid inlet is in a lower exposed side of the nozzle body.

12. A modular spray gun manifold comprising:

a plurality of spray gun modules arranged in a lateral array, a plurality of support assemblies, each spray gun module being arranged between pairs of individual support assemblies of said plurality of said plurality of support assemblies for supporting the plurality of spray gun modules in laterally spaced relation to each other;

said plurality of spray gun modules each including a nozzle body and a spray nozzle having a liquid discharge orifice;

said nozzle body of said plurality of spray gun modules each defining a central liquid passageway communicating with said spray nozzle discharge orifice of the respective spray nozzle;

said nozzle body having lateral sides disposed in abutting side by side relation to lateral sides of the adjacent pairs of the individual support assemblies;

said nozzle body each having outer exposed sides between the lateral sides;

a valve disposed within said central liquid passageway of the nozzle body for reciprocating movement between a valve closing position for preventing discharge of liquid from said spray nozzle discharge orifice and a valve open position for enabling liquid passage through said central liquid passageway and liquid discharge orifice;

said plurality of spray gun modules each having a respective liquid inlet in one of the outer exposed sides of the nozzle body of the respective spray gun module communicating with the central liquid passageway of the nozzle body of the spray gun module for directing liquid from a liquid supply remote from the spray gun module to the central liquid passageway of the nozzle body;

said plurality of spray gun modules each having an independently controllable liquid supply communicating with the liquid inlet thereof;

said plurality of support assemblies each having a liquid recirculation conduit for communicating liquid successively through said plurality of support assemblies and plurality of spray gun modules for return to a liquid supply;

said plurality of spray gun modules each having a recirculation port communicating between the central liquid passageway and the liquid recirculation conduit of an adjacent support assembly;

said valve of each spray gun module being operable when in the open position for enabling communication of liquid from the respective inlet through the central liquid passageway for discharge from the spray nozzle discharge orifice while blocking the communication of liquid from the central liquid passage to the recirculation port; and said valve being operable when in the valve closing position for blocking the flow of liquid from the central liquid passage to the spray nozzle discharge orifice and redirecting liquid from the liquid inlet to the recirculation port for communication to the recirculation conduit of the adjacent support assembly for recirculation to the liquid supply.

13. The spray gun manifold of claim 12, in which the liquid inlet communicates with the central liquid passageway at a first location, said liquid recirculation port communicating with said central liquid passage at a second location spaced from the first location, said valve having a spool disposed at a location intermediate said liquid inlet port and said liquid recirculation port when said valve is in said valve open position for enabling the flow of liquid through said central liquid passage and spray nozzle discharge orifice while blocking the flow of liquid from said liquid inlet to said recirculation port.

14. The spray gun manifold of claim 13, in which said spool of the valve when in said valve closing position being disposed at a location for permitting communication of liquid from said liquid inlet port and said central liquid passageway to the recirculation port and recirculation conduit of the adjacent support assembly.

15. The spray gun manifold of claim 14, in which the liquid inlet communicates with the central liquid passageway at a location along the central liquid passageway intermediate the spray nozzle discharge orifice and the recirculation port.

16. The spray gun manifold of claim 12, in which the liquid inlet extends transversely between the central longitudinal passageway and one of the outer exposed sides.

17. The spray gun manifold of claim 12 in which said spray nozzle is disposed in a forward exposed side of the nozzle body thereof, and said liquid inlet is in an upper exposed side of the nozzle body.

18. The spray gun manifold of claim 12 in which said spray nozzle is disposed in a forward exposed side of the nozzle body thereof, and said liquid inlet is in a lower exposed side of the nozzle body.

* * * * *